US008001743B2

(12) United States Patent
Lambertini

(10) Patent No.: US 8,001,743 B2
(45) Date of Patent: Aug. 23, 2011

(54) ACCESSORY FOR PROFILES FOR SLIDING WINDOWS OR DOORS

(75) Inventor: Marco Lambertini, San Lazzaro di Savena (IT)

(73) Assignee: GSG International S.p.A., Budrio (IT)

( * ) Notice: Subject to any disclaimer, the term of this patent is extended or adjusted under 35 U.S.C. 154(b) by 259 days.

(21) Appl. No.: 11/845,562

(22) Filed: Aug. 27, 2007

(65) Prior Publication Data

US 2008/0245000 A1 Oct. 9, 2008

(30) Foreign Application Priority Data

Apr. 3, 2007 (IT) ..... BO2007A0243

(51) Int. Cl.
*E04C 2/38* (2006.01)

(52) U.S. Cl. ..... 52/717.02; 52/207; 52/204.595; 52/656.7; 49/458; 49/431; 403/37

(58) Field of Classification Search ..... 52/207, 52/208, 204.1, 204.5, 204.51, 848, 204.591–204.599, 52/656.1–656.9, 717.01, 707.02, 172, 786.11, 52/655.1, 209, 717.02; 49/504, 428, 432, 49/408, 471, 468, 567, 458, 404, 431, 121, 49/475, 123; D25/125, 124; 403/292, 293, 403/600, 313, 310, 311, 312, 295, 401, 37
See application file for complete search history.

(56) References Cited

U.S. PATENT DOCUMENTS 2,067,118 A * 1/1937 Case ..... 49/406
2,931,434 A * 4/1960 Steel ..... 160/91
3,106,754 A * 10/1963 Grossman ..... 49/408
3,114,179 A * 12/1963 Briggs ..... 52/204.593
3,114,943 A * 12/1963 Casebolt ..... 49/468
3,136,396 A * 6/1964 Sullivan ..... 49/425
3,340,663 A 9/1967 Collard
3,393,487 A * 7/1968 Nolan ..... 52/204.51
3,402,510 A 9/1968 Johnson
3,403,490 A * 10/1968 Luedtke ..... 52/204.55
3,420,026 A * 1/1969 Nolan ..... 52/204.51
3,462,884 A * 8/1969 Bissoniere ..... 49/404
3,487,580 A 1/1970 Holliday
3,503,169 A * 3/1970 Maki et al. ..... 52/209
(Continued)

FOREIGN PATENT DOCUMENTS

BE 1008120 A3 1/1996
(Continued)

OTHER PUBLICATIONS

European Patent Office, "European Search Report", Apr. 29, 2008, for the parallel European Patent Application No. EP 07113799.6, pp. 1-6.

*Primary Examiner* — Eileen D Lillis
*Assistant Examiner* — James Ference
(74) *Attorney, Agent, or Firm* — Pearne & Gordon LLP

(57) ABSTRACT

An accessory for profiles used for making frames for sliding windows or doors comprising, amongst other things, a fixed frame formed by two crosspieces and two stiles; the profile forming the first lower crosspiece comprises two sliding tracks, parallel with one another, presented by a lower base body, and heat insulation elements; this profile having an element for connecting and joining two halves of the profile, transversally separate relative to the length of the tracks and together forming the whole of the lower crosspiece; this connecting and joining element also has heat insulation properties.

17 Claims, 5 Drawing Sheets

U.S. PATENT DOCUMENTS

| | | | | | |
|---|---|---|---|---|---|
| 3,600,857 | A | | 8/1971 | Barge et al. | |
| 3,628,289 | A | * | 12/1971 | Buffington et al. | 49/409 |
| 3,818,666 | A | * | 6/1974 | Winans | 52/204.591 |
| 3,823,524 | A | * | 7/1974 | Weinstein | 52/717.02 |
| 3,859,754 | A | * | 1/1975 | Budich et al. | 49/425 |
| 3,925,953 | A | * | 12/1975 | LaBorde | 52/745.19 |
| 3,947,998 | A | * | 4/1976 | Matsubara | 49/209 |
| 4,064,653 | A | * | 12/1977 | Randall et al. | 49/458 |
| 4,114,317 | A | * | 9/1978 | Crawley | 49/209 |
| 4,164,830 | A | * | 8/1979 | Bierlich | 52/204.593 |
| 4,185,439 | A | * | 1/1980 | Bischlipp et al. | 52/843 |
| 4,222,200 | A | | 9/1980 | Beirnes | |
| 4,257,202 | A | | 3/1981 | Biro | |
| 4,280,309 | A | * | 7/1981 | Huelsekopf | 52/204.54 |
| 4,286,716 | A | * | 9/1981 | Budich et al. | 206/577 |
| 4,304,072 | A | * | 12/1981 | Pegg | 49/63 |
| 4,370,830 | A | * | 2/1983 | Schaefer et al. | 49/413 |
| 4,447,985 | A | | 5/1984 | Weber et al. | |
| 4,478,020 | A | | 10/1984 | Jackson | |
| 4,483,099 | A | | 11/1984 | Schmidt | |
| 4,495,726 | A | | 1/1985 | Lindstrom | |
| 4,554,770 | A | | 11/1985 | Anders | |
| 4,569,154 | A | | 2/1986 | Bayer | |
| 4,624,091 | A | * | 11/1986 | Biro | 52/656.5 |
| 4,674,246 | A | | 6/1987 | Giguere | |
| 4,680,905 | A | * | 7/1987 | Rockar | 52/200 |
| 4,686,805 | A | * | 8/1987 | Forslin | 52/208 |
| 4,691,487 | A | * | 9/1987 | Kessler | 52/209 |
| 4,704,839 | A | * | 11/1987 | Kay | 52/717.02 |
| 4,725,324 | A | * | 2/1988 | Schmidt | 156/242 |
| 4,763,446 | A | | 8/1988 | Kelly | |
| 4,768,316 | A | | 9/1988 | Haas | |
| 4,799,332 | A | * | 1/1989 | Haas | 49/408 |
| 4,815,246 | A | * | 3/1989 | Haas | 52/207 |
| 4,875,316 | A | | 10/1989 | Johnston | |
| 4,922,658 | A | * | 5/1990 | Coddens | 49/458 |
| 4,922,666 | A | | 5/1990 | Rotter et al. | |
| 4,958,468 | A | * | 9/1990 | Nolan | 52/204.51 |
| 5,038,538 | A | | 8/1991 | Rozon | |
| 5,065,544 | A | * | 11/1991 | Martin | 49/177 |
| 5,099,624 | A | | 3/1992 | Valentin | |
| 5,103,589 | A | | 4/1992 | Crawford | |
| 5,280,686 | A | | 1/1994 | Davies | |
| 5,285,606 | A | * | 2/1994 | Hagemeyer | 52/204.68 |
| 5,341,600 | A | | 8/1994 | Heppner | |
| 5,363,628 | A | * | 11/1994 | Basar et al. | 52/745.19 |
| 5,553,420 | A | * | 9/1996 | Klimek | 49/501 |
| 5,555,684 | A | * | 9/1996 | Galowitz et al. | 52/204.5 |
| 5,603,585 | A | * | 2/1997 | Bruchu et al. | 403/382 |
| 5,653,060 | A | | 8/1997 | Kitada et al. | |
| 5,678,366 | A | * | 10/1997 | Nambo et al. | 52/207 |
| 5,713,167 | A | * | 2/1998 | Durham et al. | 52/204.54 |
| 5,799,449 | A | * | 9/1998 | Lyons et al. | 52/204.51 |
| 6,094,874 | A | | 8/2000 | Manzella | |
| 6,098,355 | A | * | 8/2000 | Li | 52/212 |
| 6,209,269 | B1 | * | 4/2001 | Valderrama | 52/171.3 |
| 6,243,999 | B1 | | 6/2001 | Silverman | |
| 6,311,439 | B1 | * | 11/2001 | Arcati et al. | 52/204.51 |
| 6,360,498 | B1 | * | 3/2002 | Westphal | 52/204.5 |
| 6,393,778 | B1 | * | 5/2002 | Ting | 52/204.5 |
| 6,883,279 | B2 | * | 4/2005 | Fukuro et al. | 52/209 |
| 6,968,657 | B2 | * | 11/2005 | Siudzinski et al. | 52/207 |
| 7,065,929 | B2 | | 6/2006 | Manzella | |
| 7,165,367 | B2 | * | 1/2007 | Habicht | 52/407.1 |
| 7,520,093 | B2 | * | 4/2009 | Guhl | 52/204.1 |
| 7,637,058 | B2 | * | 12/2009 | Lai | 49/425 |
| 7,694,472 | B2 | * | 4/2010 | Rawlings | 52/210 |
| 7,707,778 | B2 | * | 5/2010 | Petta et al. | 49/504 |
| 2003/0084622 | A1 | * | 5/2003 | Hornung et al. | 52/172 |
| 2003/0201071 | A1 | | 10/2003 | Kobayashi et al. | |
| 2005/0166494 | A1 | * | 8/2005 | Guhl | 52/204.1 |
| 2006/0026913 | A1 | | 2/2006 | Turner | |

FOREIGN PATENT DOCUMENTS

| | | | |
|---|---|---|---|
| CH | 321 043 | A | 4/1957 |
| DE | 26 08 686 | A1 | 9/1977 |
| DE | 2839740 | A1 | 3/1980 |
| DE | 91 05 578 | U1 | 6/1991 |
| DE | 296 09 762 | U1 | 8/1996 |
| DE | 103 53 822 | A1 | 6/2005 |
| EP | 1 353 034 | A2 | 10/2003 |
| EP | 1400653 | A1 | 3/2004 |
| GB | 1 224 714 | A | 3/1971 |
| GB | 2062734 | A | 5/1981 |
| GB | 2110283 | A | 6/1983 |
| GB | 2127470 | A | 4/1984 |
| GB | 2197903 | A | 6/1988 |

* cited by examiner

ACCESSORY FOR PROFILES FOR SLIDING WINDOWS OR DOORS

BACKGROUND OF THE INVENTION

The present invention relates to an accessory for profiles used for making sliding windows or doors.

The sliding windows or doors usually consist of:

- a fixed frame (the most simple and usual versions also having a fixed sash positioned on a first track);
- at least one movable frame or sash which slides horizontally opening and closing relative to the fixed frame (parallel with the fixed sash);
- a pair of carriages, associated on the lower crosspiece of the movable sash and resting on a second horizontal track (parallel with the first track on which the fixed sash rests), and designed to allow the movable sash to slide in both directions;
- a control element positioned on the sash and designed to control operating means with which it is possible, respectively, to release the sash relative to the fixed frame and allow it to slide so that it opens, and to lock the sash in a closed position, in which it is stably associated with the fixed frame;
- closing means acting at least between the vertical stile of the sash and the vertical stile of the fixed frame (opposite one another and in contact in the closed configuration).

The sliding window or door structured in this way is amongst the most widespread and most used on the market, since it has a high level of active safety and is suitable for architectural solutions which require large glass window or door surfaces combined with limited overall dimensions.

However, in contrast to these undoubted advantages of the sliding window or door there is an insufficient level of heat insulation relative to the other types of windows or doors (see for example windows and doors with tilt and turn opening).

The causes of this insufficient heat seal may mostly be attributed (partly based on the many tests carried out) to the fixed frame of the window or door.

More precisely, the lower rail A and upper rail of the fixed frame, rails consisting of a base profile PB from which the two tracks B1 and B2 emerge, having common surfaces between the inner zone ZI and the outer zone ZE of the environment in which the window or door is mounted: said common zones are identifiable, in particular, in the above-mentioned parallel pair of sliding tracks B1 and B2.

The architecture used to allow the sliding of the sash or sashes A1 and A2, with relative overlapping of the sashes, leaves uncovered a good part of the surfaces corresponding to the sliding tracks B1 and B2, in the sense that there is a passage of heat between the outside and the inside (see FIGS. 1 and 2).

To overcome this deficiency there are currently solutions defined as being of the "thermal break" type, which can be produced on extruded aluminum profiles and substantially consist of bars G of polyamide (a material with a low level of heat transmission) which separates—in the middle—along the whole length the profile of each crosspiece of the window or door.

Thermal energy, that is to say heat, flows from one environment to another in three basic ways: conduction, convection, irradiation. The direction of transmission is from the environment with the higher temperature towards the environment with the lower temperature. If the two environments are separated by a partition, the amount of heat which passes through it is proportional to the difference in temperature.

In the case of the sliding windows or doors (as clearly shown in FIGS. 1 and 2), this thermal break system on the frame does not allow acceptable performance to be achieved because the metal surfaces of the rails with faces common to the outside and inside, are never completely separate and so still allow the passage of heat by conduction from the inside to the outside and vice versa on the individual tracks even in the presence of the insulating bars forming the thermal break.

Another particularly critical element of the sliding window or door as regards the heat seal is identifiable in the central zone in which the sashes A1 and A2 overlap in the closed configuration.

As FIG. 1 clearly shows, the space between the two tracks, common to the inside and the outside, may lack a heat seal: at present this zone is protected with an element which—in theory—acts as a "seal", even if it has very approximate performance and absolutely does not allow a thermal break along the profile or a seal against the weather such as rain water.

In addition to this the new energy saving regulations will make it difficult to use this type of window or door if its performance cannot be adjusted in terms of insulation.

SUMMARY OF THE INVENTION

The aim of the present invention is therefore to overcome these disadvantages by providing an accessory which, combined with the profile, has high level heat insulation and weather seal properties, maintaining mechanical and aesthetic properties similar to those of traditional type profiles.

Accordingly, the present invention achieves this aim with an accessory, in particular an accessory for profiles forming sliding windows or doors which has the technical features described in one or more of the claims herein.

BRIEF DESCRIPTION OF THE DRAWINGS

The technical features of the invention, in accordance with the afore-mentioned aims, are clearly indicated in the claims herein and the advantages of the invention are more evident in the detailed description which follows, with reference to the accompanying drawings, which illustrate a preferred embodiment without limiting the scope of the invention, in which:

DESCRIPTION OF THE PREFERRED EMBODIMENTS

Figure 1:
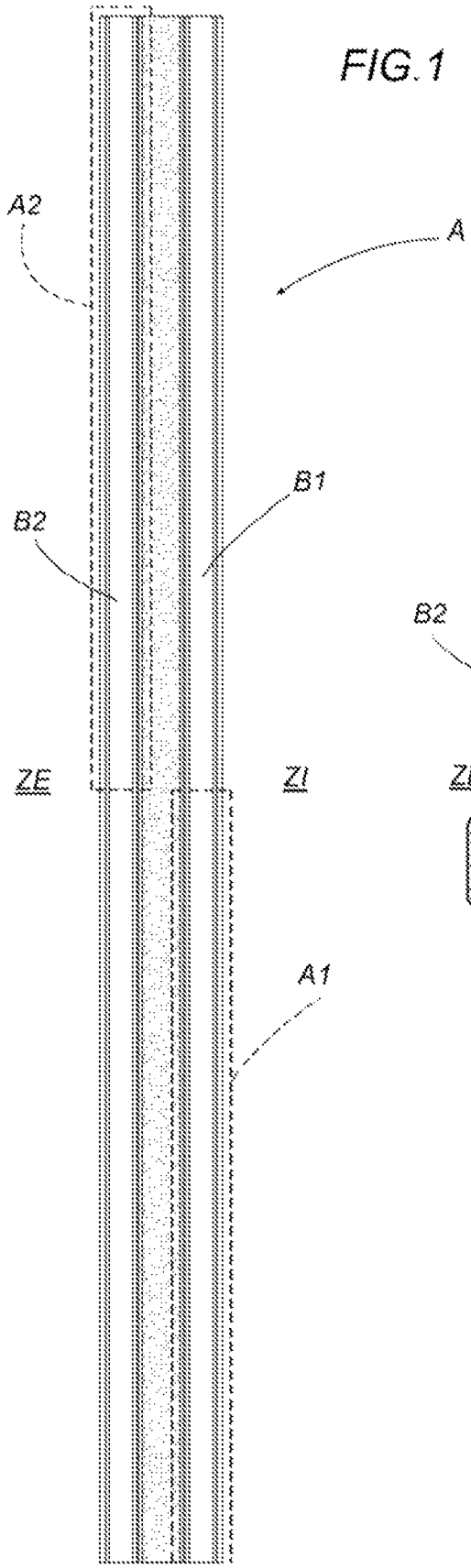
FIG.1 PRIOR ART
FIGS. 1 and 2 illustrate a profile for making sliding windows or doors of the known type, respectively in a top plan view and a schematic front view with some parts in cross-section and others cut away.
Figure 2:
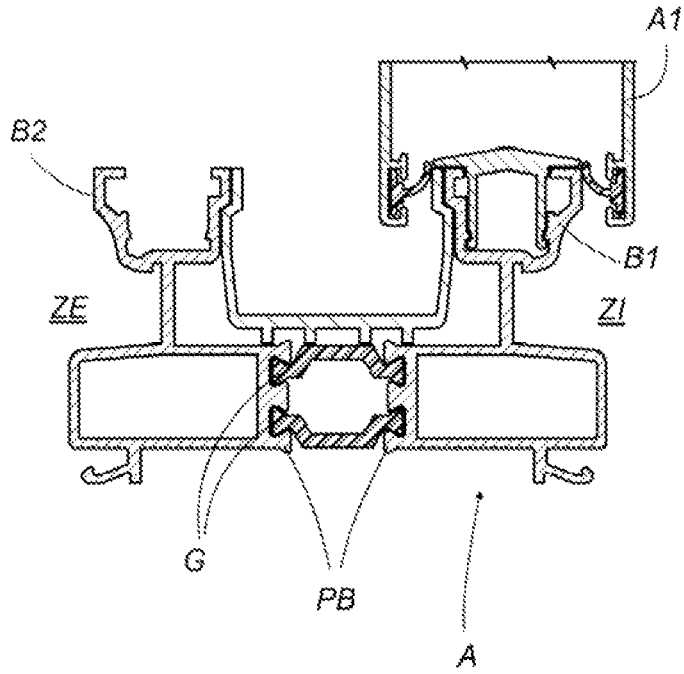
PRIOR ART FIG.2
Figure 3:
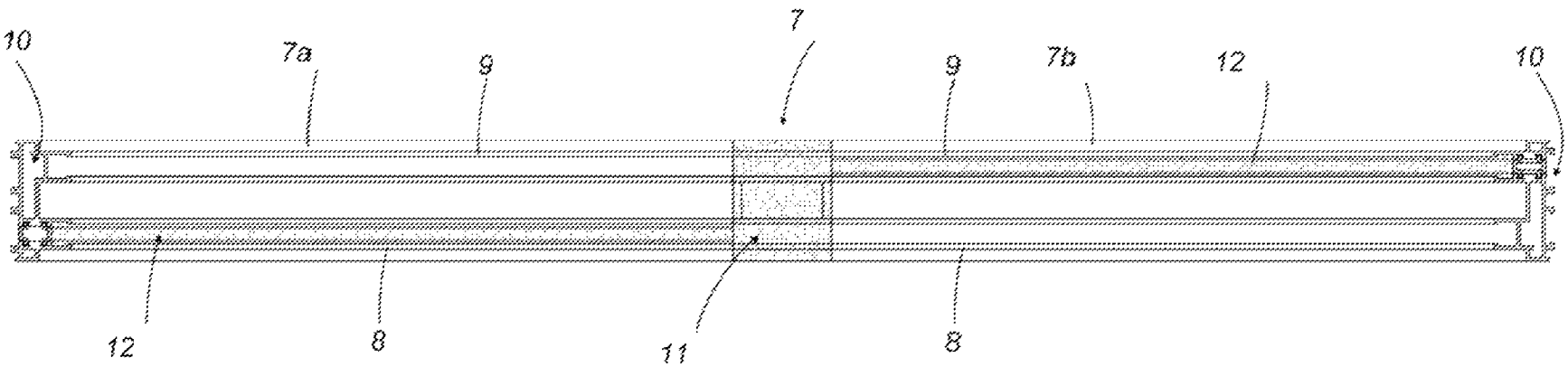
FIG. 3 is a top plan view of a profile equipped with the accessory, in accordance with the present invention.
Figure 4:
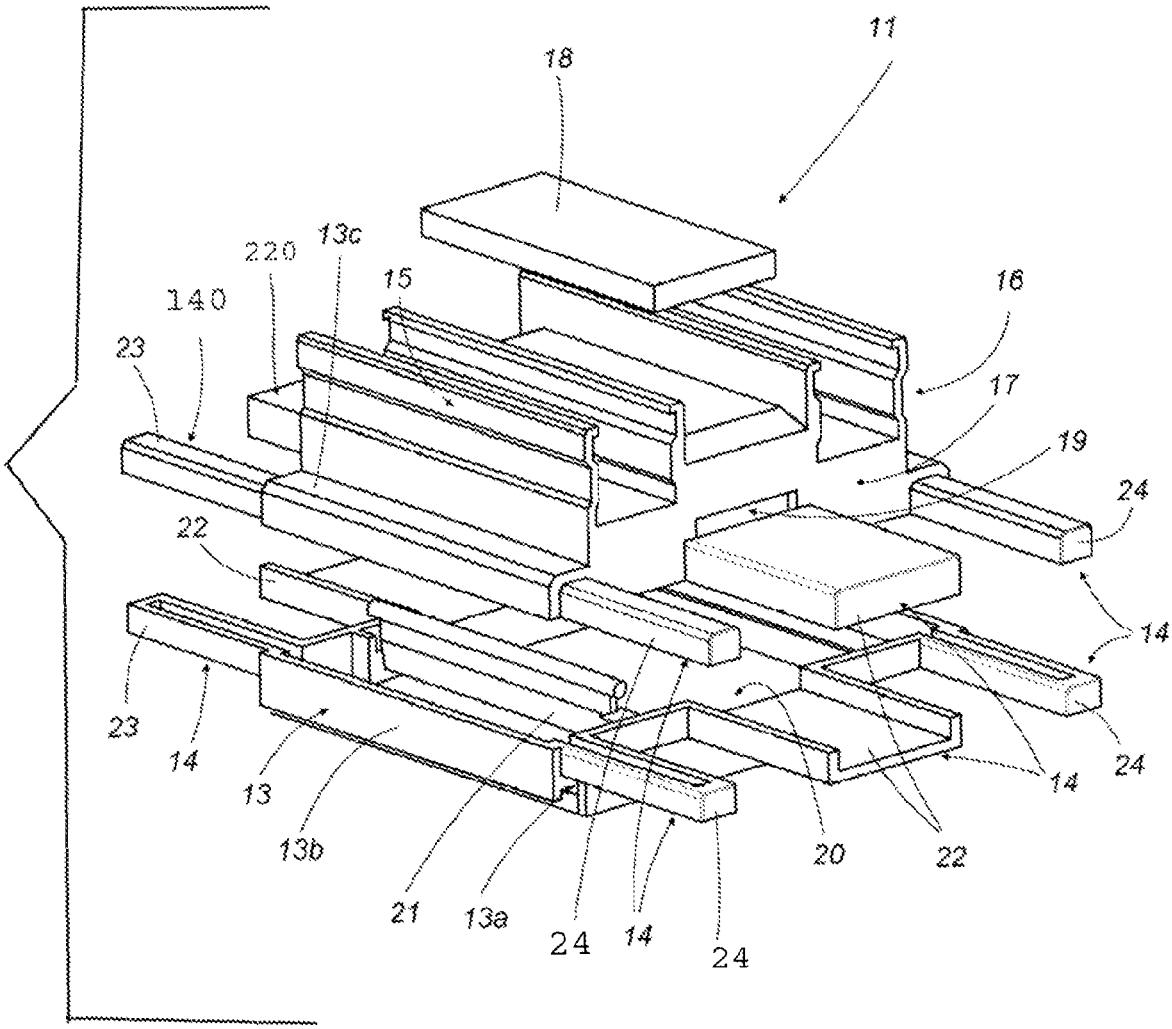
FIG. 4 is an exploded perspective view of the accessory in accordance with the invention.

With reference to the accompanying drawings, and in particular with reference to FIGS. 3 and 4, the accessory, labeled 11 as a whole, is applied on profiles 7 used to make frames for sliding windows or doors 1 comprising, amongst other things, (FIG. 7) a fixed frame 2 formed by two crosspieces 3 and 4 and two stiles 5 and 6.

As FIG. 3 clearly shows, the profile 7, forming at least the first lower crosspiece 3, comprises two sliding tracks 8 and 9, parallel with one another, presented by a lower base body 10, and also comprises heat insulation elements 12.

Positioned on the two tracks 8 and 9 there may be, respectively, a first movable frame 50 and a second frame (movable or static) 51 which completes the structure of the sliding window or door 1.

FIG. 3 also shows how the profile 7 forming the lower crosspiece 3 has an element 11 for connecting and joining two halves 7*a* and 7*b* forming the profile 7, separated transversally relative to the length of the tracks 8 and 9 and together forming the entire lower crosspiece 3.

In addition, the connecting and joining element 11 has heat insulation properties.

Obviously, the profile 7' forming the upper crosspiece 4 also has a second element 11' for connecting and joining the two halves 7'*a* and 7'*b* forming the profile 7', again separated transversally relative to the length of the tracks 8 and 9 and forming, together with the element 11', the entire upper crosspiece 4.

Again, the connecting and joining element 11' has heat insulation properties.

To simplify the description, reference is made to one element 11 or 11', since these accessory elements are both the same in terms of architecture and structural equipment.

This connecting and joining element 11, forms the central portion of the profile 7, where the halves 7*a*, 7*b*, are separated transversally and with substantially the same length.

Figure 5:
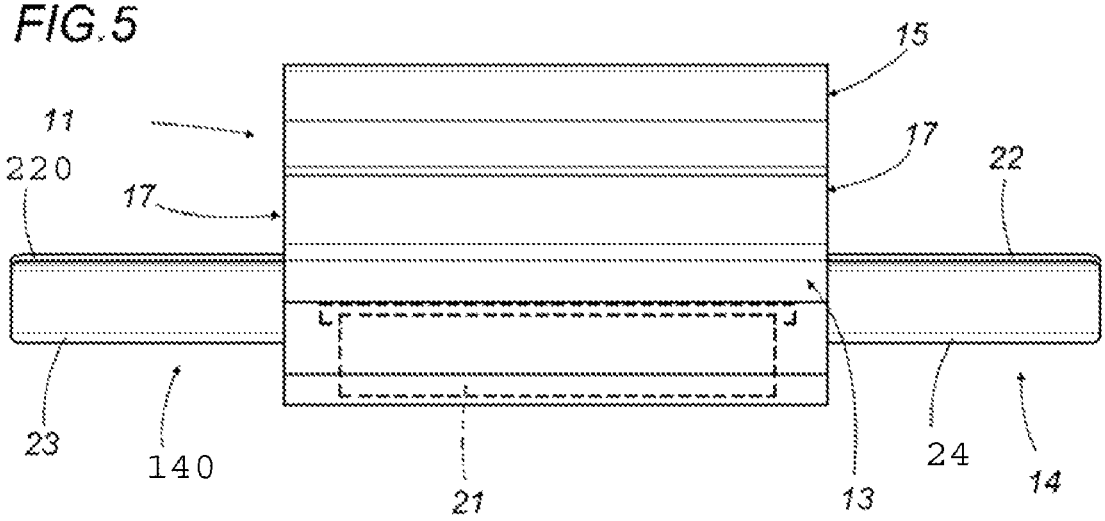
FIGS. 5 and 6 are respectively a side and a front view with some parts cut away to better illustrate others of the accessory of FIG. 4.
Figure 6:
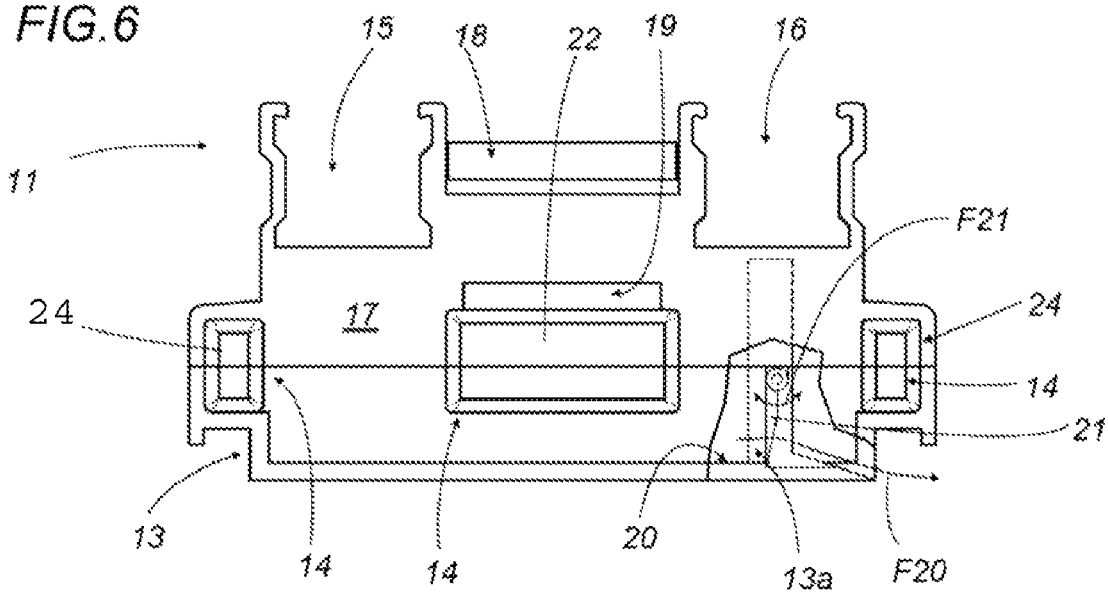

As illustrated in FIGS. 4 to 6, each connecting and joining element 11 comprises:

- a base portion 13 which can be connected with a matching fit, on both sides, with the respective base ends of each half 7*a*, 7*b*, of the profile 7 by relative connection elements 14, 140 projecting from both sides of the base portion 13;
- two pairs of upper projections 15 and 16, parallel with one another, forming relative connections or joins for the first and second tracks 8 and 9 of each half 7*a*, 7*b*, and so as to obtain, in practice, a relative first and second longitudinal track 8, 9 without interruption along the entire length of the profile 7.

In more detail, for each end side in contact with the halves 7*a*, 7*b* the base portion 13 comprises at least one vertical surface 17 for contact with the heat insulation or thermal break elements 12 positioned on the corresponding halves 7*a*, 7*b* of the profile 7 (for example, one or more flat rods extending below the tracks 8 and 9).

In addition, the base portion 13 may comprise, on the upper surface inserted between the two pairs of upper projections 15, 16, a seal element 18 or seal (for example made of rubber) between the two upper zones of each half 7*a*, 7*b*.

An additional feature of this element 11 is the presence, on one or, preferably, both end sides of the base portion 13, of an opening or slot 19 for the passage, in practice, of fluid, that is to say rain, so as to collect the latter in a lower part of the base portion 13, having a reservoir-style inner zone 20 for collecting the water.

Connected on one side of the lower part, in practice positioned towards the outside of the environment in which it is mounted, there is a valve element 21 designed to allow the water collected to be emptied to the outside.

In more detail, the valve element consists of a rigid wall 21 pivoting at both sides in the lower part of the base portion 13.

Figure 7:
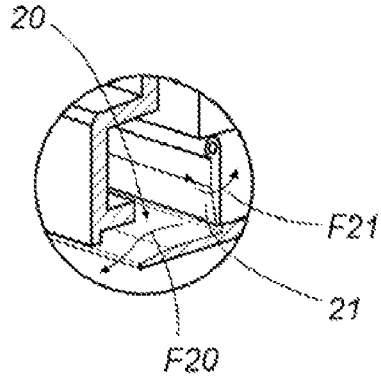
FIG. 7 is a perspective view with some parts cut away and others in cross-section of a detail of the accessory from FIGS. 4 to 6.
Figure 8:
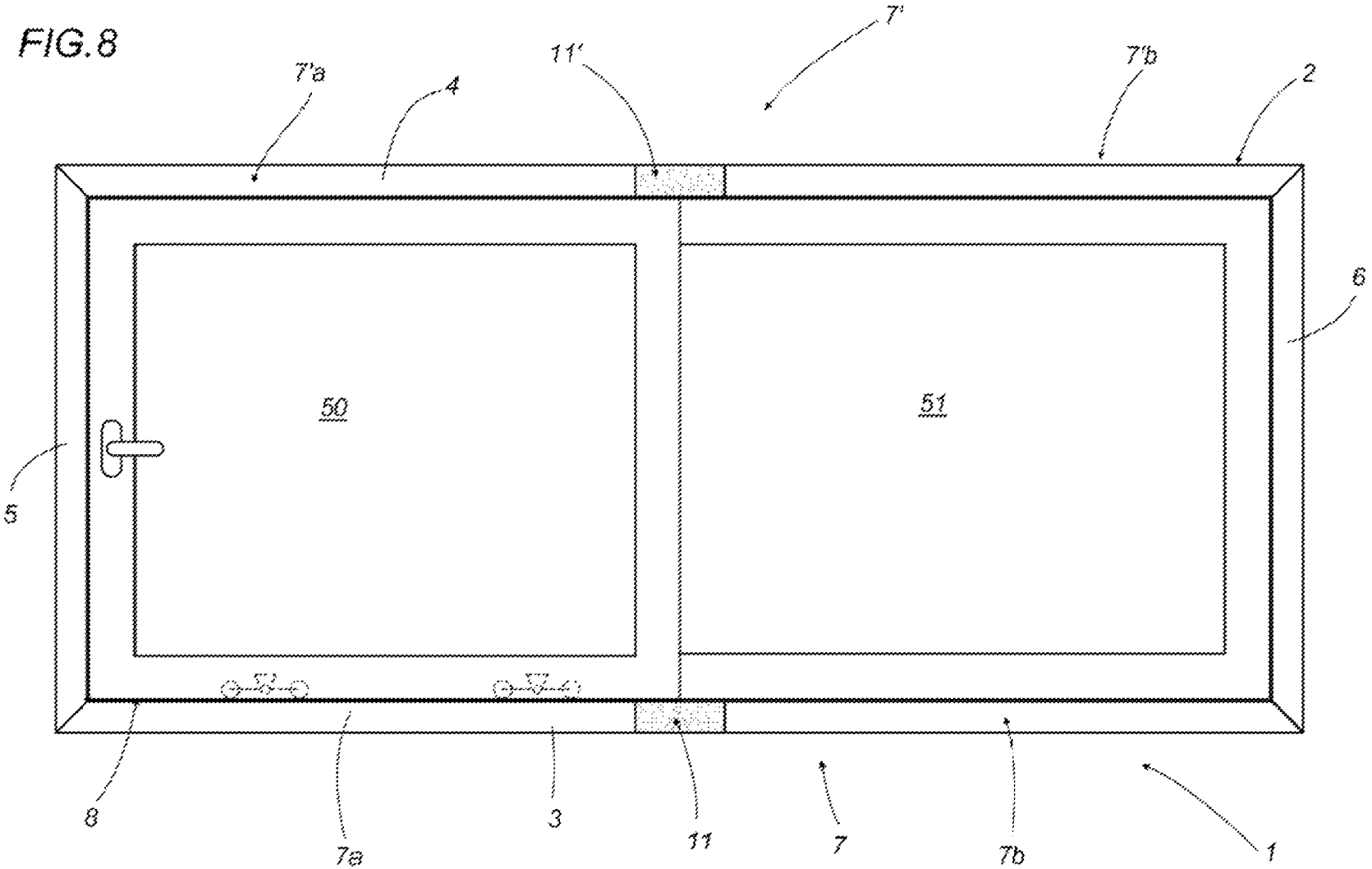
FIG. 8 is a schematic front view of a sliding window or door obtained with the profile in accordance with the present invention.

The rigid wall 21, substantially forming a door, is positioned close to an opening 13*a* made on the side part of the base portion 13 so that, when the rigid wall 21 is rotated (due to the quantity of water present in the reservoir 20), the water collected is emptied out (see arrows F20 and F21 in FIGS. 6 and 7).

In order to correctly apply the rigid wall 21 inside the connecting and joining element 11, the base portion 13 may be divided into two halves, upper 13*b* and lower 13*c*, which can be connected during assembly to form the element 11.

The connection elements 14 may vary in shape and number depending on the type of cross-section of the halves 7*a*, 7*b* of the profile 7.

In the case illustrated, by way of example only and without limiting the scope of the invention, the connection elements 14, 140 consist of a horizontal projection 22, 220 projecting from each of the end sides of the base portion 13 and connecting, with a matching fit, by sliding, with a portion of the relative half 7*a*, 7*b* of the profile 7.

In addition there is a pair of second rods 23, 24, projecting from the relative end sides of the base portion 13, each pair 23 and 24 positioned on both sides of the first horizontal projection 22, 220 and designed to connect with a matching fit, by sliding, in a relative portion of a corresponding half 7*a*, 7*b* of the profile 7.

Therefore, with an accessory structured in this way the preset aims are achieved with a simple architectural variation of the conventional type of profiles and the addition of the connecting and joining element 11.

The presence of the accessory allows heat seal results to be achieved which are better than those on conventional profiles.

Interrupting the lower and, if necessary, upper tracks, connecting with the insertion of the joining accessory or plug, allows the creation of an effective thermal barrier which, for each surface facing the outside, has a thermal break system without any uninterrupted element between the inside and the outside.

Finally, with this accessory, the profile made in this way achieves a plurality of advantages which may be summarized as follows:

- improved overall thermal performance of the sliding window or door mounted;
- reduced working on the frame profile;
- improved resistance to infiltration by water thanks to the increase in the capacity of the drainage devices and the structuring of the joining plug, without the need for additional work on the profile;
- improved frame transportability thanks to the possibility of assembling the plugs on site and therefore with greatly reduced crosspiece sizing;
- simplification of the process for making the window or door as a whole.

The invention described above is susceptible of industrial application and may be modified and adapted in several ways without thereby departing from the scope of the inventive concept. Moreover, all details of the invention may be substituted by technically equivalent elements.

What is claimed is:

1. A sliding window or door apparatus comprising a frame and a sliding window or door slidable horizontally within the frame, the frame comprising a horizontal upper crosspiece, a horizontal lower crosspiece, a first vertical stile and a second vertical stile, the two crosspieces being joined by the two stiles to form the frame, said lower crosspiece comprising a connecting and joining element, a first section and a second section, the lower crosspiece having a sliding track, the lower crosspiece sliding track being formed by the first section, the connecting and joining element and the second section, the sliding window or door being slidable horizontally in the lower crosspiece sliding track, said first section being spaced apart from said second section, said connecting and joining element joining said first section to said second section, said connecting and joining element having a front, a back, a first side, a second side, a top and a bottom, said connecting and joining element having a first track and a second track which are parallel with each other and which run from the front of the connecting and joining element to the back of the connecting and joining element, at least one of said connecting and joining element tracks being a sliding track having a cross-sectional configuration, said connecting and joining element sliding track being a part of said lower crosspiece sliding track, said connecting and joining element sliding track engaging a portion of said sliding window or door to form a sliding connection, said connecting and joining element being made of heat insulating material.

2. The apparatus of claim 1, wherein said element is a polyamide element.

3. The apparatus of claim 1, wherein a first front projection extends horizontally from the front of the element and into a first horizontal cavity in the first section and thereby engages said first section.

4. The apparatus of claim 3, wherein a first back projection extends horizontally from the back of the element and into a first horizontal cavity in the second section and thereby engages said second section.

5. The apparatus of claim 4, wherein a second front projection extends horizontally from the front of the element and into a second horizontal cavity in the first section and thereby engages said first section, and wherein a second back projection extends horizontally from the back of the element and into a second horizontal cavity in the second section and thereby engages said second section.

6. The apparatus of claim 5, wherein a third front projection extends horizontally from the front of the element and into a third horizontal cavity in the first section and thereby engages said first section, and wherein a third back projection extends horizontally from the back of the element and into a third horizontal cavity in the second section and thereby engages said second section.

7. The apparatus of claim 6, wherein one of said first, second and third front projections is located between the other two of said front projections, and wherein one of said first, second and third back projections is located between the other two of said back projections.

8. The apparatus of claim 3, said first front projection having an upper surface, said upper surface extending to an opening in the front of the element so that rain water flowing along said upper surface may flow through said opening into an interior of the element.

9. The apparatus of claim 1, further comprising a seal running parallel with the first track and with the second track and being located between the first track and the second track.

10. The apparatus of claim 9, wherein said seal is made of rubber.

11. The apparatus of claim 1, wherein the front of the element has a first opening for the passage of rain water into an interior of the element.

12. The apparatus of claim 11, wherein the back of the element has an opening for the passage of rain water into an interior of the element.

13. The apparatus of claim 11, wherein the element has an interior zone for collecting rain water.

14. The apparatus of claim 11, wherein the element has a second opening and a passageway between the first opening and the second opening, said second opening being an opening in the first side or the second side of the element, the passageway and second opening being configured to permit rain water flowing in through the first opening to flow out through the second opening.

15. The apparatus of claim 14, further comprising a valve for rain water in the passageway.

16. The apparatus of claim 15, wherein the valve is configured so that, when sufficient rain water collects between the first opening and the valve, the valve will open and permit collected rain water to flow out through the second opening.

17. The apparatus of claim 16, wherein the valve is a wall rotatable about a horizontal axis, said wall extending downwardly from said horizontal axis.

* * * * *